US011394111B1

(12) United States Patent
Khushrushahi

(10) Patent No.: US 11,394,111 B1
(45) Date of Patent: Jul. 19, 2022

(54) ELECTRONICALLY RECONFIGURABLE ANTENNA

(71) Applicant: Notch, Inc., Cambridge, MA (US)

(72) Inventor: Shahriar Khushrushahi, Cambridge, MA (US)

(73) Assignee: Notch, Inc., Cambridge, MA (US)

( * ) Notice: Subject to any disclaimer, the term of this patent is extended or adjusted under 35 U.S.C. 154(b) by 0 days.

(21) Appl. No.: 16/993,732

(22) Filed: Aug. 14, 2020

Related U.S. Application Data

(60) Provisional application No. 62/886,728, filed on Aug. 14, 2019.

(51) Int. Cl.

| | |
|---|---|
| ***H01Q 1/42*** | (2006.01) |
| ***H01Q 15/14*** | (2006.01) |
| ***H01Q 19/18*** | (2006.01) |
| ***H01Q 19/17*** | (2006.01) |

(52) U.S. Cl.
CPC ..... *H01Q 1/425* (2013.01); *H01Q 15/147* (2013.01); *H01Q 15/148* (2013.01); *H01Q 19/17* (2013.01); *H01Q 19/18* (2013.01)

(58) Field of Classification Search
CPC ..... H01Q 15/0013; H01Q 15/002; H01Q 15/0026; H01Q 21/20; H01Q 21/205
See application file for complete search history.

(56) References Cited

U.S. PATENT DOCUMENTS 4,672,378 A 6/1987 Drabowitch et al.
5,652,631 A * 7/1997 Bullen ..... H01Q 1/425 343/753
5,969,689 A * 10/1999 Martek ..... H01Q 1/246 343/758
7,173,565 B2 * 2/2007 Sievenpiper ..... H01Q 15/24 343/909
7,679,563 B2 * 3/2010 Werner ..... F41H 11/136 343/700 MS (Continued)

FOREIGN PATENT DOCUMENTS

CN 102646869 A * 8/2012
CN 109950700 A * 6/2019
CN 111146598 A * 5/2020

OTHER PUBLICATIONS

Wang et al.; A electronically steerable radiator and reflector array antenna based on Three-Dimensional Frequency Selective Structure; 2012 5th Global Symposium on Millimeter Waves (Year: 2012).*

(Continued)

*Primary Examiner* — Ab Salam Alkassim, Jr.
(74) *Attorney, Agent, or Firm* — Sunstein LLP

(57) ABSTRACT

A reconfigurable antenna systems includes a set of envelopes of active metamaterial panels, each envelope in the set being shaped to approximate a surface of at least partial revolution of a curve about an axis, wherein the surface defines a focal locus; a wideband antenna array disposed within the focal locus; and a controller, coupled to the panels, configured to activate each one of the panels, so as to control a property of each of the panels, the property selected from the group consisting of transmissivity, reflectivity, absorption, phase, polarization, bandwidth, angle sensitivity, resonant frequency, and combinations thereof.

14 Claims, 29 Drawing Sheets

(56) References Cited

U.S. PATENT DOCUMENTS

| | | | | |
|---|---|---|---|---|
| 8,633,866 | B2 * | 1/2014 | Sarabandi | H01Q 15/0026 343/909 |
| 8,842,056 | B2 * | 9/2014 | Batchelor | H01Q 15/0066 343/909 |
| 9,362,615 | B2 * | 6/2016 | Cannon | H01Q 5/00 |
| 9,450,304 | B1 * | 9/2016 | Edalati | H01Q 15/002 |
| 9,800,444 | B2 | 10/2017 | Moon et al. | |
| 10,490,903 | B2 * | 11/2019 | Foo | H01Q 19/19 |
| 10,833,402 | B2 * | 11/2020 | Khushrushahi | H01Q 3/46 |
| 10,862,203 | B2 * | 12/2020 | Cordone | H01Q 1/425 |
| 2006/0114170 | A1 * | 6/2006 | Sievenpiper | H01Q 15/002 343/909 |
| 2011/0133978 | A1 * | 6/2011 | Sim | H01Q 17/00 342/1 |
| 2011/0210903 | A1 * | 9/2011 | Sarabandi | H01Q 15/0053 343/904 |
| 2012/0098628 | A1 * | 4/2012 | Batchelor | H01Q 15/0066 333/24 C |
| 2015/0280957 | A1 | 10/2015 | Lim et al. | |
| 2015/0349418 | A1 * | 12/2015 | Patron | H01Q 9/44 343/836 |
| 2019/0036224 | A1 * | 1/2019 | McCollough | H04B 7/02 |
| 2019/0260120 | A1 * | 8/2019 | Khushrushahi | H01Q 1/241 |

OTHER PUBLICATIONS

Zhang et al.; A Novel Reconfigurable Antenna Based on Active Band Reflective Frequency Selective Surface; Proceedings of the 2012 IEEE International Symposium on Antennas and Propagation (Year: 2012).*

Liangyi et al.; Reconfigurable Sectoral Antenna Using an Cylindrical Frequency Selective Surface; Proceedings of the 2012 IEEE International Symposium on Antennas and Propagation (Year: 2012).*

International Searching Authority/US—International Search Report and the Written Opinion, International Application No. PCT/US2019/018197, 16 pages, dated May 1, 2019.

* cited by examiner

Software Algorithm

ELECTRONICALLY RECONFIGURABLE ANTENNA

RELATED APPLICATION

The present application claims the benefit of U.S. provisional application Ser. No. 62/886,728, filed Aug. 14, 2019, which application is hereby incorporated herein by reference in its entirety.

STATEMENT REGARDING FEDERALLY SPONSORED RESEARCH OR DEVELOPMENT

This invention was made with Government support under Contract Number FA875119CA018 awarded by the U.S. Air Force. The U.S. Government has certain rights in the invention.

TECHNICAL FIELD

The present invention relates to antennas, and in particularly to electronically reconfigurable wideband antenna systems.

BACKGROUND ART

As is known in this art, beam-forming capabilities for antennas are highly desirable as they lead to increased gain in the desired direction, resulting in increased communication ranges and decreased interference from other directions. Adding beam-steering allows for the ability to steer these beams to communicate in multiple directions.

Directional beam-steering can be achieved by using multi-antenna arrays or mechanical steering. In a multi-antenna array, the steering of the radiation pattern can be achieved by changing the amplitude and phase of the signal output of different antenna elements of the array. These arrays require a complicated architecture of electronics and control increasing cost. In a mechanically steered antenna, moving dish reflectors are used to direct antenna radiation in a desired direction. Although simple to design, these mechanically steered antennas are limited in their applications due to their large size and high cost.

U.S. Pat. No. 9,450,304 discloses an embodiment of an electronically controlled beam-switching antenna. It uses 6 frequency selective surfaces surrounding a dipole to switch the antenna beam in 6 directions in the azimuthal plane.

U.S. Pat. No. 8,514,142 discloses a reconfigurable antenna utilizing a reflective screen which can be controlled by integrated switches. This screen is cylindrical in shape and is used to steer the beam 360 degrees in the azimuthal plane.

There are academic papers that propose an aperture antenna that is a curve of revolution to achieve 360 wide scanning. For example, in "The Parabolic Dome Antenna: A Large Aperture, 360 degree, Rapid Scan Antenna" by J. D. Barab et. al. also has a curve of revolution in the shape of a parabola but with a focal circle, instead of a focal point, with a horn antenna on a movable platform along that circle. The horn antenna is oriented to have a polarization at 45 degrees with the polar angle, is mechanically rotated to illuminate one side of the dome. The reason for this is the dome is made of wire mesh aligned at 45 degrees angle to match the horn's polarization and be reflective on the illuminated side but be transparent on the other side whereby the Radio Frequency (RF) energy can escape from the dome. Another paper, "A Toroidal Microwave Reflector" by George D. M Peeler and Donald H. Archer, is an extension of this work whereby the surface of revolution is made of a curve that is elliptical to reduce phase errors.

SUMMARY OF THE EMBODIMENTS

In one embodiment, the invention provides a reconfigurable antenna system. The antenna system of this embodiment includes a set of envelopes of active metamaterial panels, each envelope in the set being shaped to approximate a surface of at least partial revolution of a curve about an axis, wherein the surface defines a focal locus; a wideband antenna array disposed within the focal locus; and a controller, coupled to the panels, configured to activate each one of the panels, so as to control a property of each of the panels, the property selected from the group consisting of transmissivity, reflectivity, absorption, phase, polarization, bandwidth, angle sensitivity, resonant frequency, and combinations thereof.

Optionally, the curve is a parabola.

Optionally, the curve is an arc of a circle about an axis.

Optionally, the curve is elliptical.

Also, optionally, the controller is further configured to select a set of panels to be activated in a manner that causes formation of a beam of RF energy having a desired orientation in space and beamwidth, and wherein the envelopes are configured to support such beam formation.

As a further option, the surface of revolution has a maximum radius and a height that is greater than twice the maximum radius.

In a further embodiment, the reconfigurable antenna comprises of at least two envelopes in the set of envelopes.

Optionally, at least one of the envelopes is configured to overlie at least a portion of another one of the envelopes.

Also, optionally, the reconfigurable antenna comprises of at least three envelopes in the set of envelopes.

As a further option, the envelopes are configured to provide at least two layers, wherein each layer substantially surrounds the antenna.

As a further option, the controller is further configured to activate a set of panels in a manner as to establish, in the set of envelopes, a set of RF windows, each window transmissive of RF signals at a specified RF frequency.

Optionally, the controller is further configured to activate a set of panels in a manner as to establish, in the set of envelopes, a set of RF windows, each window reflective of RF signals at a specified RF frequency.

Optionally, the controller is further configured to activate a set of panels as to establish an antenna system having a performance adjustable over 360 degrees of azimuth.

As a further option, the controller is further configured to activate a set of panels as to establish an antenna system having a performance adjustable over 180 degrees of elevation.

Optionally, each active metamaterial panel of a given envelope comprises a set of cells, regularly repeated over the envelope, wherein each cell is separately addressable and coupled to the controller.

BRIEF DESCRIPTION OF THE DRAWINGS

The foregoing features of embodiments will be more readily understood by reference to the following detailed description, taken with reference to the accompanying drawings, in which:

FIG. 1A is a perspective view in which an embodiment is seen as a generally prolate spheroid, formed as a surface of revolution of a parabolic curve, as viewed from above and off-axis from a pole.

FIG. 1B is a vertical section of the same embodiment as that of FIG. 1A, also viewed from above and off-axis from a pole.

FIG. 1C is a perspective view in which the represented embodiment is seen as an oblate spheroid, formed as a surface of revolution of an arc of a circle, as viewed from above and off-axis from a pole.

FIG. 1D is a vertical section of the same embodiment as that of FIG. 1C, also viewed from above and off-axis from a pole.

FIG. 2A shows the position of the wideband antenna and a cross-sectional view of the curve that forms the surface of rotation and its construction.

FIG. 2B shows operation of the metamaterial antenna enclosure and the RF paths taken by electromagnetic waves under a beam-steering operation.

FIG. 3A illustrates the vertical slice of the antenna array enclosure embodiment of FIG. 1A and the smallest active metamaterial slice that can be electronically and independently activated in this embodiment.

FIG. 3B illustrates the vertical slice of the antenna array enclosure embodiment of FIG. 1B and the smallest active metamaterial slice that can be electronically and independently activated in this embodiment.

FIG. 4A is an antenna array enclosure configuration that steers the RF energy in the westward azimuthal direction.

FIG. 4B is an antenna array enclosure configuration that steers the RF energy in the south-eastern azimuthal direction.

FIG. 4C is an antenna array enclosure configuration that steers the RF energy in the eastern azimuthal direction.

FIG. 5A illustrates an embodiment in which the antenna array enclosure is configured to tilt the RF beam in the southern direction.

FIG. 5B illustrates an embodiment whereby the antenna array enclosure is configured to tilt the RF beam in the northern direction.

FIG. 10A is a graphic rendering of a band-pass metamaterial configured to be in the transparent state in accordance with an embodiment of the present invention.

FIG. 10B is a graphic rendering of the band-pass metamaterial of FIG. 10A here configured to be in its reflective state in accordance with an embodiment of the present invention.

FIG. 10C is a perspective rendering of a cell having a square element periodic structure with electronic components configured to form an active band-pass metamaterial unit with dimensions that control a property of the active band-pass metamaterial in accordance with an embodiment of the present invention.

FIG. 10D is perspective rendering of a cell having a square element periodic structure with electronic components, similar to that of FIG. 10C, but configured to form an active band-reject metamaterial unit with dimensions that control a property of the active band-reject metamaterial in accordance with an embodiment of the present invention.

DETAILED DESCRIPTION OF SPECIFIC EMBODIMENTS

Figure 1A:
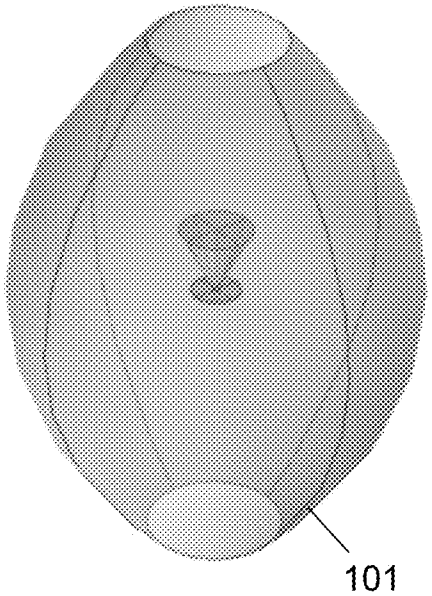
FIGS. 1A, 1B, 1C, and 1D are views of simplified embodiments of the present invention, showing an antenna array enclosure made of active metamaterial panels in a dome shaped structure that can completely or partially surround the wideband, high power antenna.

Definitions. As used in this description and the accompanying claims, the following terms shall have the meanings indicated, unless the context otherwise requires:

A "set" includes at least one member.

An "antenna array" is a set of interconnected antenna elements that can generate an isotropic, omnidirectional, or even directional radiation pattern.

To "surround" an antenna array with a set of metamaterial panels means to physically arrange the set of metamaterial panels so that when the set of metamaterial panels are addressed the set can be configured to modify a pattern of radiation or reception associated with the antenna array, regardless whether the antenna array is fully enclosed by the set of metamaterial panels.

"Frequency band" is a continuous uninterrupted frequency range, that the metamaterial is tuned for, spanning from a minimum frequency to a maximum frequency.

"Resonant frequency band" is a frequency band or multi-band for which the metamaterial is tuned.

"Bandwidth" of a metamaterial is the range of a frequency band, for which the metamaterial is tuned, and is the difference between the maximum and minimum frequency in the frequency band.

A "center frequency" of a metamaterial is a single frequency that is in the center of the resonant frequency band for which the metamaterial is tuned.

"Multi-band" of a metamaterial is a set of frequency bands centered at different center frequencies with different bandwidths.

A "passive" control is control achieved without the continuous application of power, although power may be applied initially in changing a geometric or other configuration.

An "active" control is control achieved through the sustained application of power over time.

"Electrical control" or "electronic control" of a metamaterial is control, achieved using applied voltage and/or current, of a property of the metamaterial or any component thereof, the addition of a PIN diode, a PN diode, a varactor diode, a transistor, or a lumped element such as a capacitor, inductor, resistor or other non-linear or linear switching element, and combinations thereof.

A "metamaterial" is an engineered material having frequency selective behavior in a member selected from the group consisting of a surface, a volume, and combinations thereof, by virtue of a set of cells organized in a repeated pattern in the material. The metamaterial's frequency selective behavior is tuned at a resonant frequency such that a wave impinging on the metamaterial experiences properties of the material including transmissivity, reflectivity, absorption, phase shift, polarization change, bandwidth change and change in angle sensitivity. These properties of the metamaterial, including the tuned resonant frequency, can be modified by mechanical control, magnetic control, electrical control or electronic control and combinations thereof; these forms of control may be active or passive.

To "control a property of the metamaterial" is to control a parameter associated with the metamaterial in connection with a wave impinging thereon, the parameter selected from the group consisting of transmissivity, reflectivity, absorption, phase, polarization, bandwidth, angle sensitivity, resonant frequency, and combinations thereof.

To "activate" a metamaterial panel is to control a property of the metamaterial panel.

A "panel" is an active or passive metamaterial that is made up of electronically addressable individual subpanels.

A "subpanel" is an active or passive metamaterial that forms a subset or building block of a "panel" that can be individually controlled.

An "envelope" of active metamaterial panels is a collection of such panels structured into a shape, wherein the shape is selected from the group consisting of a rigid shape and a deformable shape. The collection in an envelope can, but need not, form a complete enclosure.

A "section" is a portion of an envelope made of contiguous active metamaterial panels.

A "slice" is a section in which the active panels define an approximately constant azimuthal angle over a selected elevation range of angles.

An "enclosure" is a set of active or passive metamaterial panels or a combination of both, that are used to surround an antenna partially or completely.

A "client" is any entity that sends and receives data from the antenna control system.

A "surface of revolution" is a surface in Euclidean space created by rotating a curve around an axis of rotation. The extent of rotation around the axis can be up to 360 degrees, although 360 degrees is not required.

A "surface of partial revolution" is a surface in Euclidean space created by rotating a curve around an axis of rotation over an extent of less than 360 degrees.

A "focal locus" of a surface of revolution is a collection of places where parallel rays reflected by the surface appear to meet. When the surface of revolution is formed by parabola, the focal locus is a focus point on the axis of revolution or a focal ring around the axis of revolution, depending on the geometry of the surface of revolution. An object "disposed within the focal locus" is located at the focus point of the locus or is on or within the focal ring of the focal locus.

An "RF window" in a set of envelopes is a areal expanse therein that has been configured by a controller to have a property selected from the group consisting of (i) transmissive of RF signals at a specified RF frequency and (ii) reflective of RF signals at a specified RF frequency.

A "cell" of a metamaterial panel of a given envelope of a reconfigurable antenna is a unit, having a conductive pattern and, optionally, a set of components, that is regularly repeated over the envelope to establish an RF property for the panel.

FIGS. 1A, 1B, 1C, and 1D are views of simplified embodiments of the present invention, showing an antenna array enclosure made of active metamaterial panels in a dome shaped structure that can completely or partially surround the wideband, high power antenna.

FIG. 1A is a perspective view in which an embodiment is seen as a generally prolate spheroid, formed as a surface of revolution of a parabolic curve, as viewed from above and off-axis from a pole. The structure is constructed by mechanically affixing active rigid and flat metamaterial panels to achieve a curve of a parabolic nature. The metamaterial panels can also be made of flexible substrate commonly used with flexible printed circuit boards. In the case of using flexible substrates, a single flexible active metamaterial, or multiple flexible active metamaterials, affixed mechanically, could be used to form this shape.

Figure 1B:
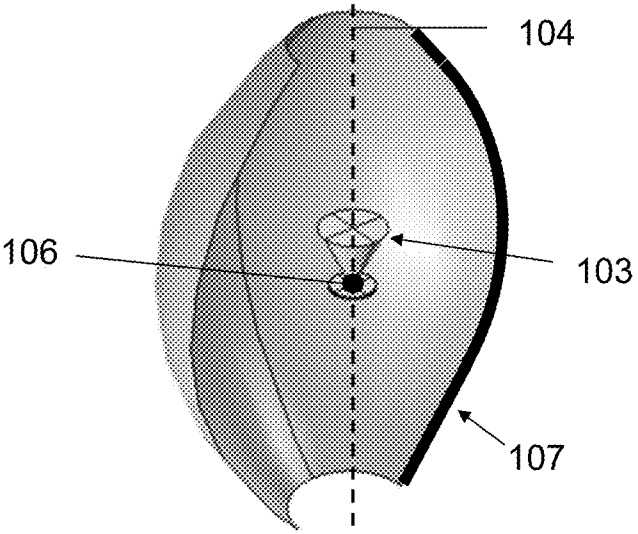

FIG. 1B is a vertical section of the same embodiment as that of FIG. 1A, also viewed from above and off-axis from a pole. A wideband antenna illustrated as a discone antenna, 103, can be placed along the central axis, 104, of the antenna array enclosure with a focal point 106 and a parabolic curve, 107, forming the surface of revolution 101. The antenna array enclosure can also be constructed by rotating a section of the parabolic arc about an axis parallel to the latus rectum of the parabola. This will result in a focal locus whereby the wideband antenna of 103 can be placed anywhere along or within this locus. The surface of revolution that forms the antenna array enclosure can be made of different curves.

Figure 1C:
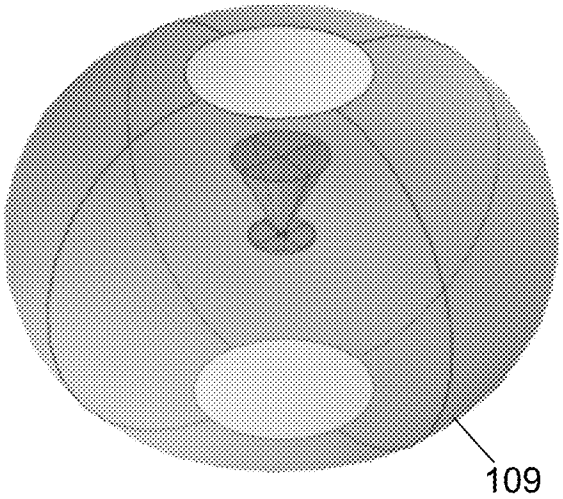
Figure 1D:
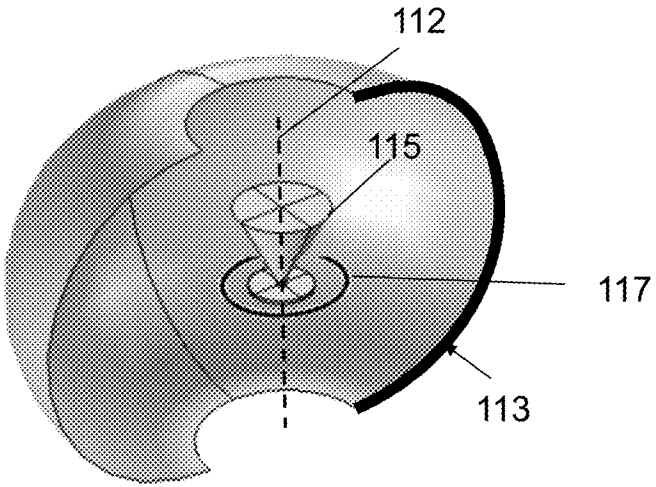

FIG. 1C is a perspective view in which the represented embodiment is seen as an oblate spheroid, formed as a surface of revolution of an arc of a circle, as viewed from above and off-axis from a pole. FIG. 1D is a vertical section of the same embodiment as that of FIG. 1C, also viewed from above and off-axis from a pole. The antenna enclosure of 109 is made of a surface or revolution with a curve that is an arc of a circle 113 with a wide band antenna, 115, placed along the central axis, 112, or confined within or on a focal locus 117.

Figure 2A:
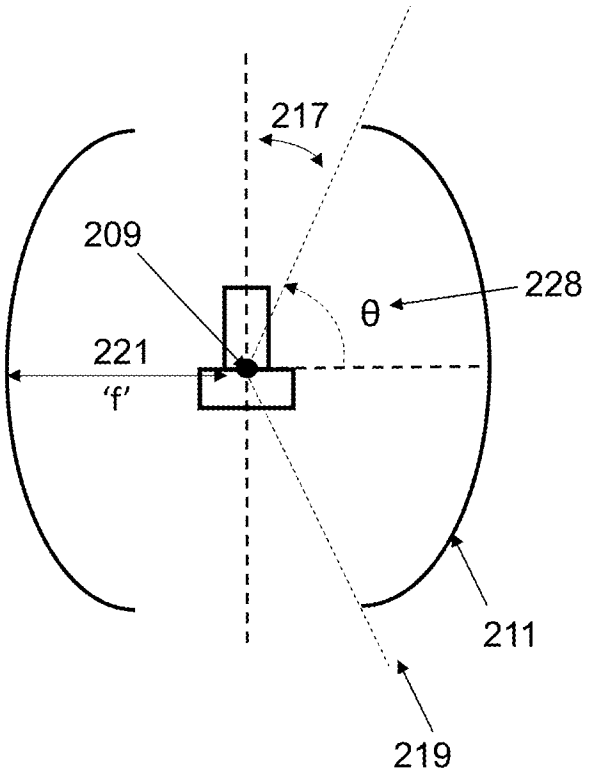
FIGS. 2A and 2B are axisymmetric cross-sectional views of a single antenna enclosure system, formed as a surface of revolution of a parabolic curve, indicating the position of the wideband antenna within a metamaterial enclosure in accordance with an embodiment of the present invention.
Figure 2B:
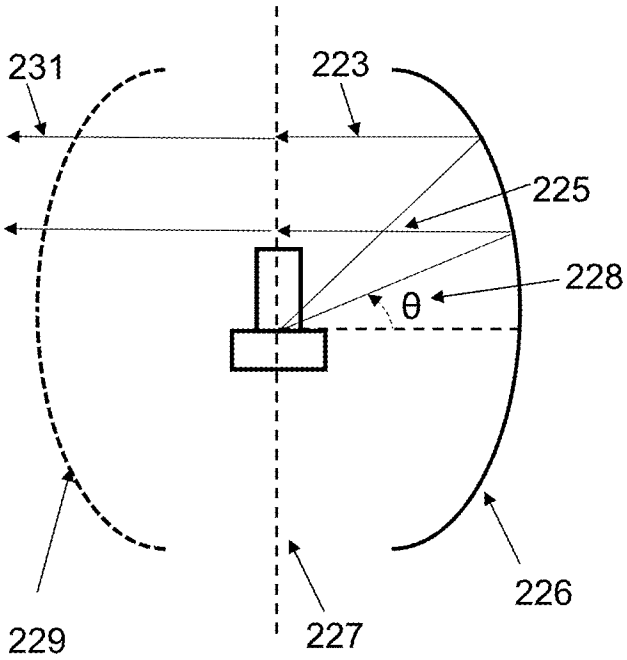

FIGS. 2A and 2B are axisymmetric cross-sectional views of a single antenna enclosure system, formed as a surface of revolution of a parabolic curve, indicating the position of the wideband antenna within a metamaterial enclosure in accordance with an embodiment of the present invention.

FIG. 2A shows the position of the wideband antenna and a cross-sectional view of the curve that forms the surface of rotation and its construction. The wideband antenna is placed at the focal point 209 of the antenna enclosure surface of rotation that is a parabolic curve 211. The parabolic curve 211 can be expressed in polar coordinate form as $$\rho = \frac{2f}{1 + \cos\theta}$$

with focal length 'f' and angle θ as shown in 228. The focal length 221 should be larger or equal to the far field distance of the lowest operating frequency of the antenna. The curve has a focal point 209, and sweeps along the polar direction, described by the spherical coordinate system, from polar angle 217 through 219.

FIG. 2B shows operation of the metamaterial antenna enclosure and the RF paths taken by electromagnetic waves under a beam-steering operation. The parabolic curve is chosen because regardless of the RF path taken by individual waves 223 and 225, the wave fronts reflect off the first surface 226 and when reaching the latus rectum 227 will all be aligned, making the RF beam coherent, reducing phase errors. The wave fronts can then continue to the opposed surface 229 and pass through the opposite side of the parabolic dome 231 since the active metamaterial panels on this curve are transparent to the RF energy. Further phase modifications can be made to the RF wave passing through the transparent sections and this is described FIG. 13 and its accompanying text.

Figure 3A:
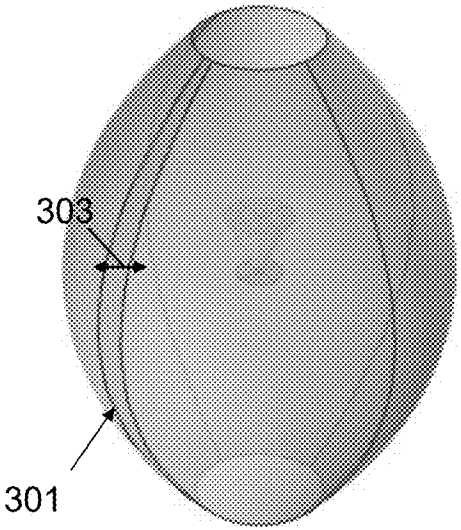
FIGS. 3A and 3B are representations of the embodiments of FIGS. 1A and 1C respectively, illustrating activation of vertical slices of the antenna array enclosure system for beam-steering.
Figure 3B:
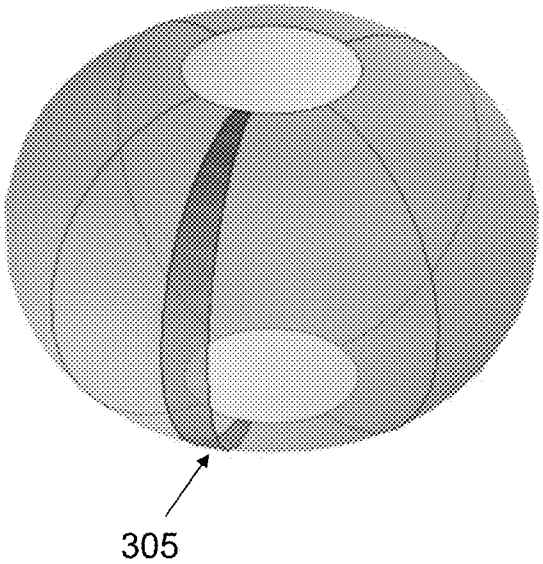

FIGS. 3A and 3B are representations of the embodiments of FIGS. 1A and 1C respectively, illustrating activation of vertical slices of the antenna array enclosure system for beam-steering.

FIG. 3A illustrates the vertical slice of the antenna array enclosure embodiment of FIG. 1A and the smallest active metamaterial slice that can be electronically and independently activated in this embodiment. The smallest individual vertical active metamaterial slice that can be electronically and independently controlled is 301. The width of these smallest slices that can be activated is determined by the periodicity of the repeating elements used in the active metamaterial design. The larger the periodicity, the bigger the slice width 303.

FIG. 3B illustrates the vertical slice of the antenna array enclosure embodiment of FIG. 1B and the smallest active metamaterial slice that can be electronically and independently activated in this embodiment. The smallest individual vertical active metamaterial slice, 305, is shown here to be visibly wider than that of 303 in FIG. 3A. The smallest slice width can be activated on other shapes and on any plurality of metamaterial reflector shapes.

Figure 4A:
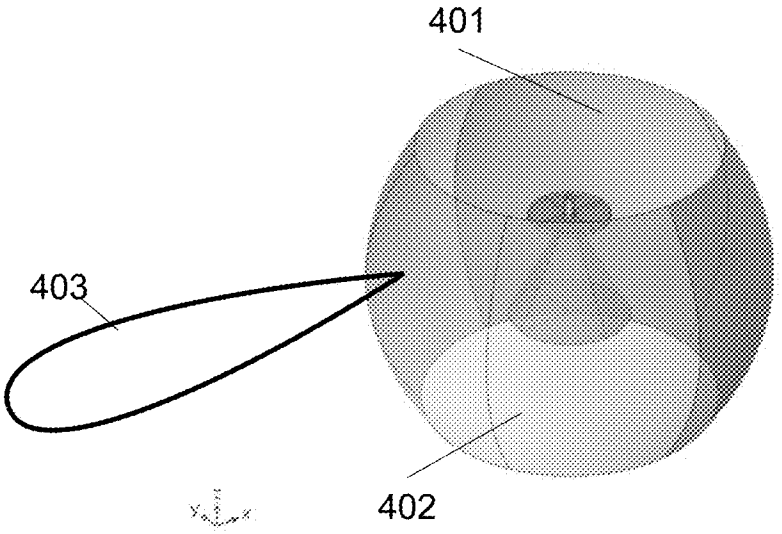
FIGS. 4A, 4B, and 4C are perspective renderings of an embodiment in which the active metamaterial panels define a generally spherical enclosure for the antenna array, viewed from above and off-axis from a pole, wherein a number of these vertical metamaterial slices of the antenna array enclosure are activated to beam-steer the RF beam in the azimuthal direction.
Figure 4B:
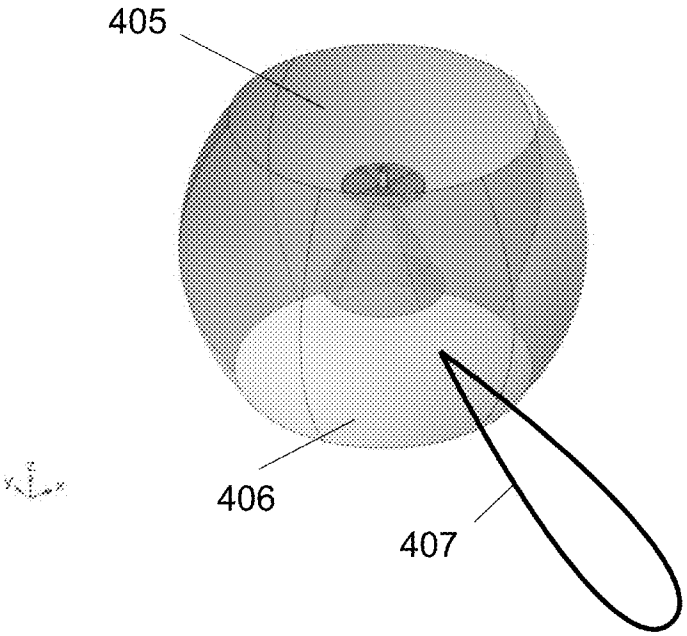
Figure 4C:
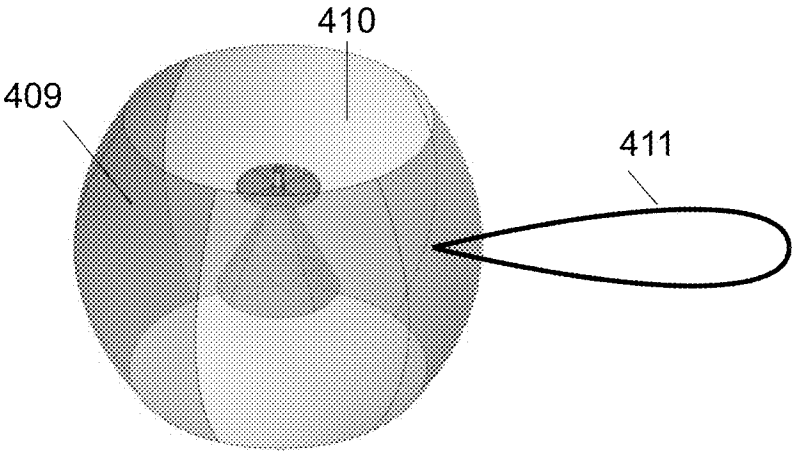

FIGS. 4A, 4B, and 4C are perspective renderings of an embodiment in which the active metamaterial panels define a generally spherical enclosure for the antenna array, viewed from above and off-axis from a pole, wherein a number of these vertical metamaterial slices of the antenna array enclosure are activated to beam-steer the RF beam in the azimuthal direction.

FIG. 4A is an antenna array enclosure configuration that steers the RF energy in the westward azimuthal direction. By activating a set of metamaterial slices to be reflective 401, while activating the remaining metamaterial slices to be transmissive 402, the RF beam can be concentrated in the westward direction 403.

FIG. 4B is an antenna array enclosure configuration that steers the RF energy in the south-eastern azimuthal direction. A set of metamaterial slices 405 are activated to be reflective with the remaining set of metamaterial slices, 406, activated to be transparent to steer in the south-eastward azimuthal direction 407.

FIG. 4C is an antenna array enclosure configuration that steers the RF energy in the eastern azimuthal direction. By activating the metamaterial slices, 409, to be reflective and activating the remaining slices 410 to be transparent, the RF energy can be steered in the eastward azimuthal direction 411.

Figure 5A:
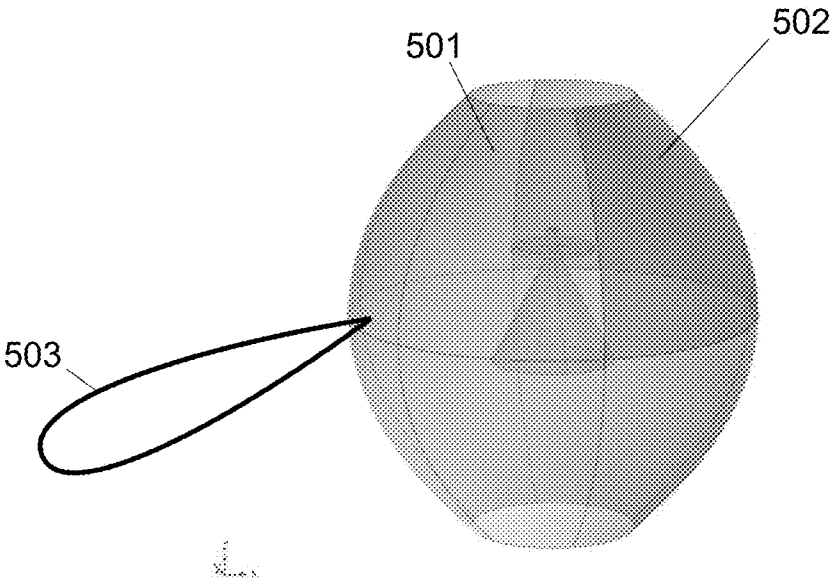
FIGS. 5A and 5B are perspective renderings of an embodiment, generally similar to that of FIGS. 1A and 1B, viewed off-axis from a pole and from slightly above, illustrating how the antenna array enclosure is used to tilt the RF energy in the elevation direction by appropriately activating relevant metamaterial sections above or below the equator to be reflective while leaving the remaining sections transmissive.
Figure 5B:
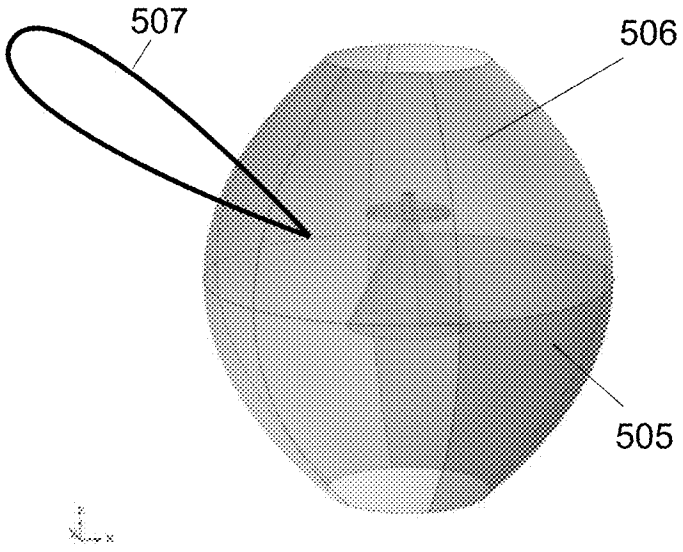

FIGS. 5A and 5B are perspective renderings of an embodiment, generally similar to that of FIGS. 1A and 1B, viewed off-axis from a pole and from slightly above, illustrating how the antenna array enclosure is used to tilt the RF energy in the elevation direction by appropriately activating relevant metamaterial sections above or below the equator to be reflective while leaving the remaining sections transmissive.

FIG. 5A illustrates an embodiment whereby the antenna array enclosure is configured to tilt the RF beam in the southern direction. By activating the metamaterial section 502 to be reflective while the remaining metamaterial sections 501 are activated to be transparent, the RF energy will concentrate in the southern direction 503.

FIG. 5B illustrates an embodiment whereby the antenna array enclosure is configured to tilt the RF beam in the northern direction. By activating the metamaterial section 505 to be reflective while the remaining metamaterial sections 506 are activated to be transparent, the RF energy will concentrate in the northern direction 507.

Figure 6:
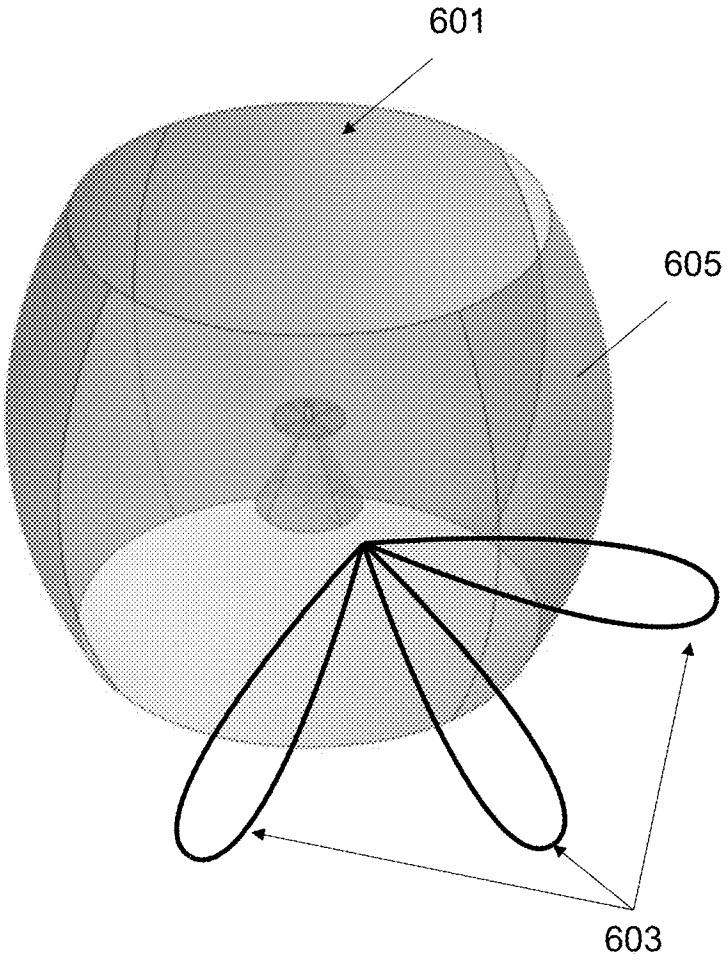
FIG. 6 is a perspective rendering of another embodiment, similar to that of FIGS. 4A, 4C, and 4C, viewed from above and off-axis from a pole, illustrating how the antenna array enclosure is used to create multiple beams by activating metamaterial slices to increase the size of the antenna aperture.

FIG. 6 is a perspective rendering of another embodiment, similar to that of FIGS. 4A, 4C, and 4C, viewed from above and off-axis from a pole, illustrating how the antenna array enclosure is used to create multiple beams by activating metamaterial slices to increase the size of the antenna aperture. The antenna aperture can be increased by activating a large set of active metamaterial parabolic slices and sections 601 to be reflective, while leaving the rest of the metamaterial sections and slices 605 as transmissive, to even allow multiple pencil beams 603 that radiate in azimuthal and polar directions. This approach enables wide scan control of multiple beams of RF energy in any direction of interest while also boosting and controlling the gain in that direction.

Figure 7:
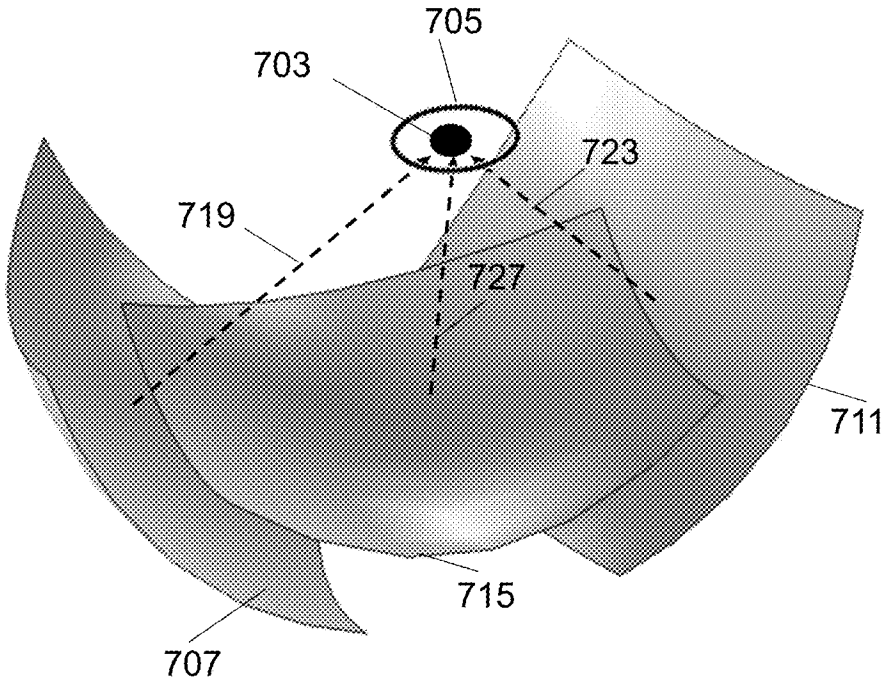
FIG. 7 is a perspective rendering of another embodiment in which the antenna array enclosure is made of a plurality of piecewise or continuous differently shaped curves or straight sections.

FIG. 7 is a perspective rendering of another embodiment in which the antenna array enclosure is made of a plurality of piecewise or continuous differently shaped curves or straight sections. Three curved surfaces 707, 711, 715 that overlap each other and are pointed to optimally receive or transmit from a wideband antenna or directional feed antenna placed at the focal point 703. Although the three curved sections 707, 711, 715 are aligned to a single overlapping focal point 703, they can be arranged to point to non-overlapping multiple focal points or a focal locus. A wideband antenna or feed horn can be placed at the focal point or along or within a focal locus 705 to maximize reception or transmission and minimize phase error. Traditional metal reflectors like 707 and 711 would be blocked by such overlapping sections, 715, but by constructing the antenna array enclosures using metamaterials with this shape, each of the curved sections can be controllably made reflective or transmissive to optimally receive/transmit in three directions. By keeping curved surface 715 and 711 transparent, curved surface 707 can be made reflective to optimally transmit or receive RF energy from the direction 719 with minimal impediment from reflectors 715 or 711. To optimally operate in the direction 727, only curved surface 715 would have to be made reflective while the remaining surfaces 707 and 711 left transparent. In the same way, for direction 723 only 711 would have to be left reflective with curved surfaces 707 and 715 transparent.

Figure 8A:
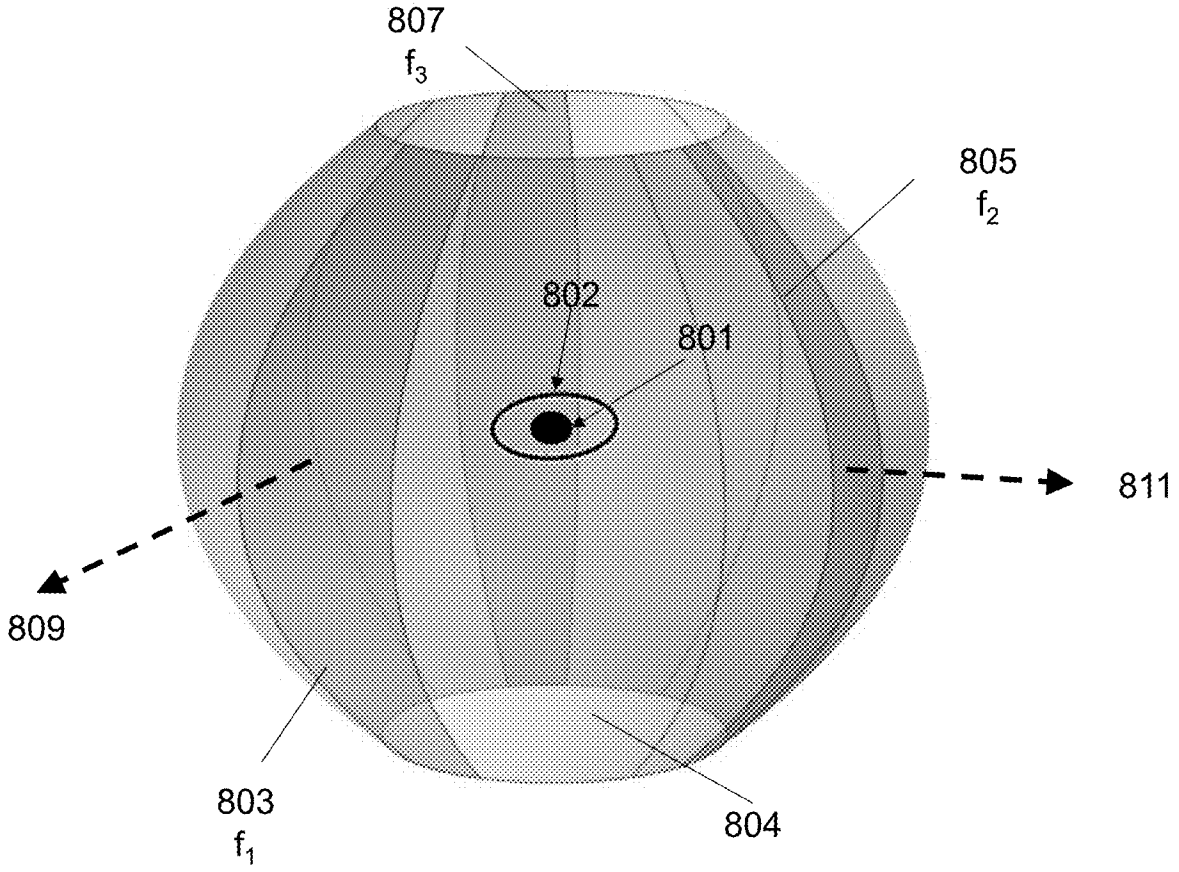
FIG. 8A is a perspective rendering of another embodiment of the present invention, generally similar to the embodiments of FIGS. 1A through 1D, viewed off-axis from a pole and from slightly above, illustrating a parabolic curve antenna array enclosure, through which multiple RF frequencies are transmitted in different directions by activating selected slices of the enclosure to be transmissive at different RF frequencies.

FIG. 8A is a perspective rendering of another embodiment of the present invention, generally similar to the embodiments of FIGS. 1A through 1D, viewed off-axis from a pole and from slightly above, illustrating a parabolic curve antenna array enclosure, through which multiple RF frequencies are transmitted in different directions by activating selected slices of the enclosure to be transmissive at different RF frequencies. The receive/transmit antenna is placed at the focal point 801 or within a focal locus 802 and the highlighted metamaterial parabolic slices 803, 805, and 807 are made transmissive at different frequencies, ($f_1$,$f_2$,$f_3$ respectively) while the unhighlighted slices 804 are reflective to all frequencies. Slice 803 is transmissive at frequency $f_1$, allowing RF energy to be transmitted out of the enclosure in the direction 809. Similarly, RF energy at frequency $f_2$ will be transmitted through slice 805 out of the enclosure in the direction 811, and through slice 807 at frequency $f_3$.

Figure 8B:
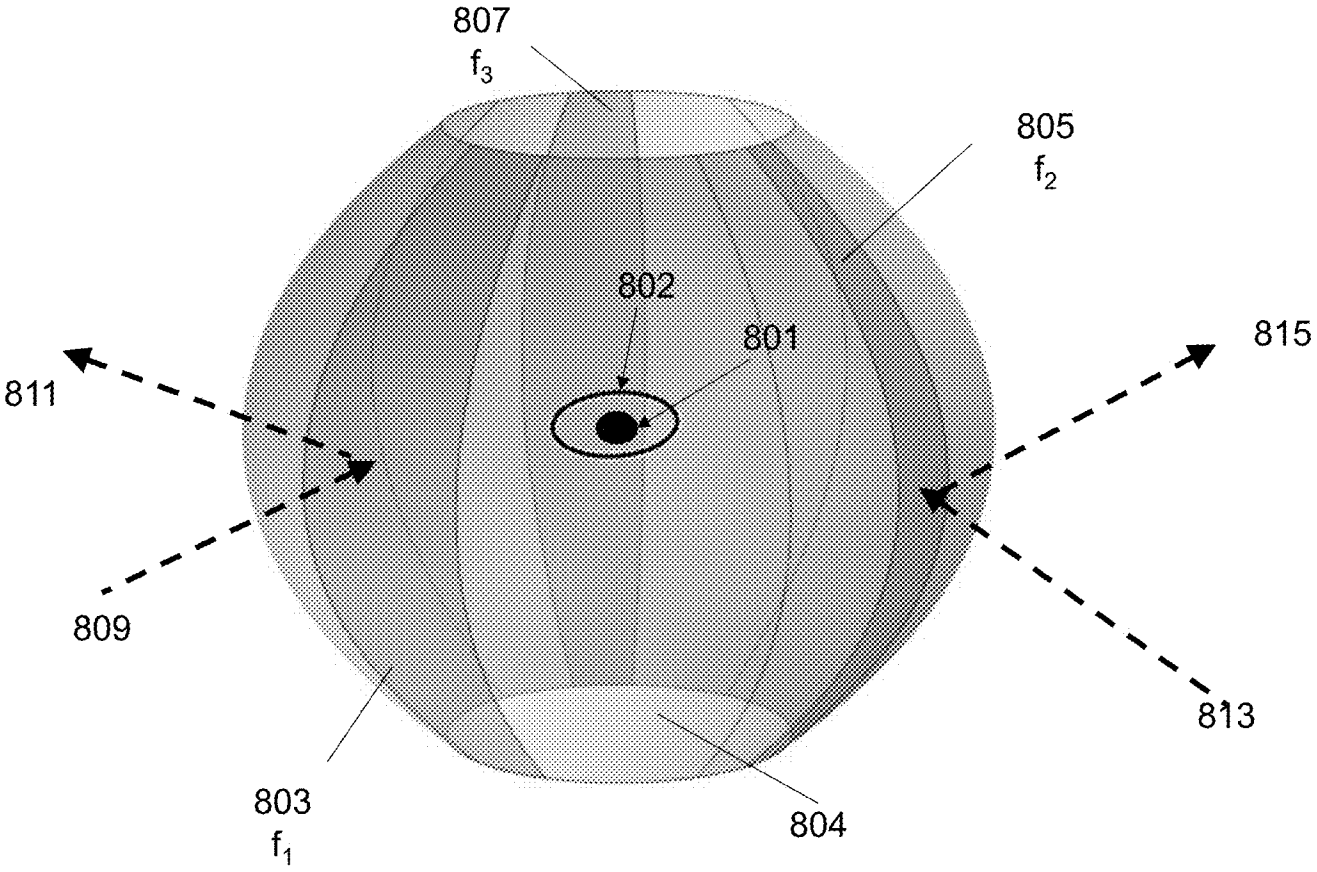
FIG. 8B is a perspective rendering of another embodiment of the present invention, generally similar to the embodiment of FIG. 8A, in which highlighted slices are configured to be reflective (as opposed to transmissive) at selected different RF frequencies.

FIG. 8B is a perspective rendering of another embodiment of the present invention, generally similar to the embodiment of FIG. 8A, in which highlighted slices are configured to be reflective (as opposed to transmissive) at selected RF frequencies. The slices 803, 805, 807 are therefore in this embodiment made reflective to reject RF frequencies ($f_1$,$f_2$, $f_3$ respectively). Specifically slice 803 reflects RF energy 809 off the surface in direction 811 with the remaining sections 804 made transmissive. Similarly, slice 805 is configured to be reflective at $f_2$ so that RF energy 813 is reflected off the surface in the direction 815.

Figure 9A:
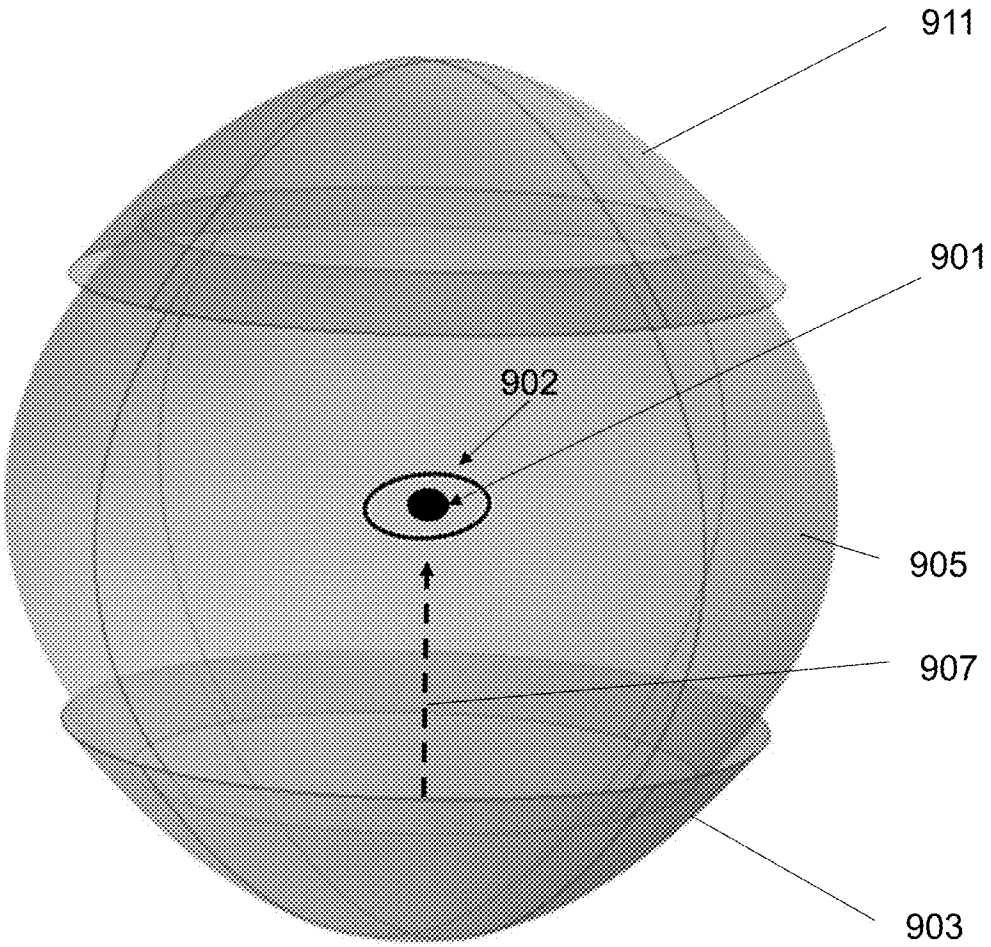
FIGS. 9A and 9B are perspective renderings of another embodiment of the present invention, generally similar to the embodiments of FIGS. 1A through 1D, in which the enclosure is generally spheroidal, viewed above an equator, illustrating use of a plurality of curved metamaterial reflectors to optimally receive or transmit RF energy from all directions azimuthally and at every elevation from the antenna array as placed at a focal point, or focal locus.
Figure 9B:
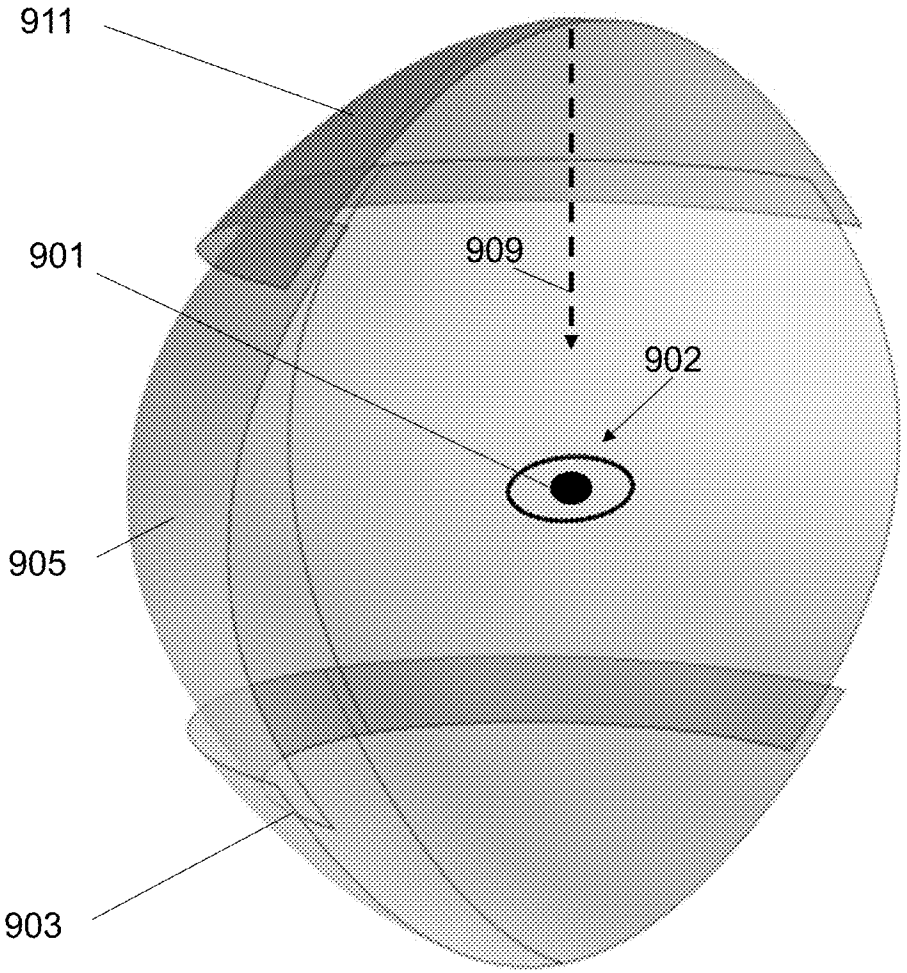

FIGS. 9A and 9B are perspective renderings of another embodiment of the present invention, generally similar to the embodiments of FIGS. 1A through 1D, in which the enclosure is generally spheroidal, viewed above an equator, illustrating use of a plurality of curved metamaterial reflectors to optimally receive or transmit RF energy from all directions azimuthally and at every elevation from the antenna array as placed at a focal point, or focal locus. The antenna array placed at the focal point 901 or focal locus 902 of the plurality of curved metamaterial reflectors can optimally receive or transmit RF energy from all directions azimuthally and at every elevation. The plurality of metamaterial enclosures includes enclosures 905, 903 and 911, of which 903 is activated to optimally receive or transmit RF energy in the vertical northward direction as shown in FIG. 9A. FIG. 9B is a vertical section of FIG. 9A but with the enclosure 911 activated to optimally receive or transmit RF energy in the vertical southward direction. The metamaterial section that is a parabolically shaped surface of revolution 903 can be activated to be reflective, with sections 905 and 903 activated to be transparent, to optimally receive/transmit in the vertical direction 907. Similarly, section 911 can be activated to be reflective, while sections 905 and 903 are activated to be transparent, to optimally receive/transmit in the downward direction 909. By activating appropriate metamaterial sections of 905, the RF energy can be steered azimuthally as described in connection with FIG. 4. By controlling the transmissivity and reflectivity of appropriate metamaterial sections of 905, 911 and 903, the RF energy can be steered in any desired direction azimuthally and over any desired elevation angle.

FIGS. 10A, 10B, 10C and 10D illustrate the periodic structure forming the building block of the active metamaterial in accordance with an embodiment of the present invention.

Figure 10A:
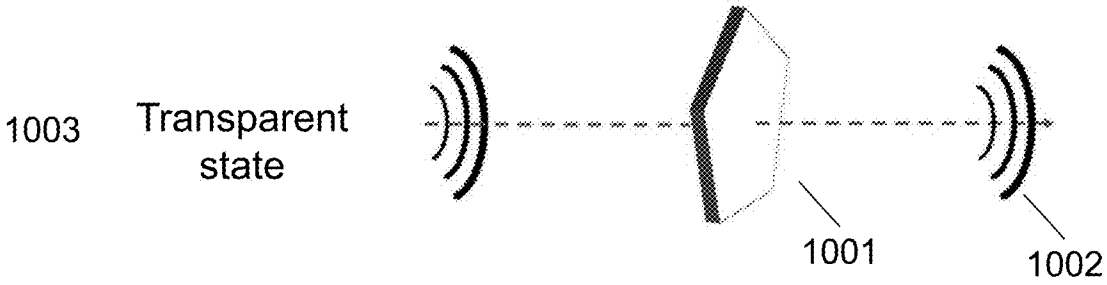
FIGS. 10A, 10B, 10C and 10D illustrate the periodic structure forming the building block of an active metamaterial in accordance with an embodiment of the present invention.

FIG. 10A is a graphic rendering of a band-pass metamaterial configured to be in the transparent state in accordance with an embodiment of the present invention. The metamaterial is designed to be transparent at a resonant frequency band and the electromagnetic wave at this pass-band frequency, 1002, is transmitted through the metamaterial 1001 while rejecting RF frequencies not in the passband.

Figure 10B:
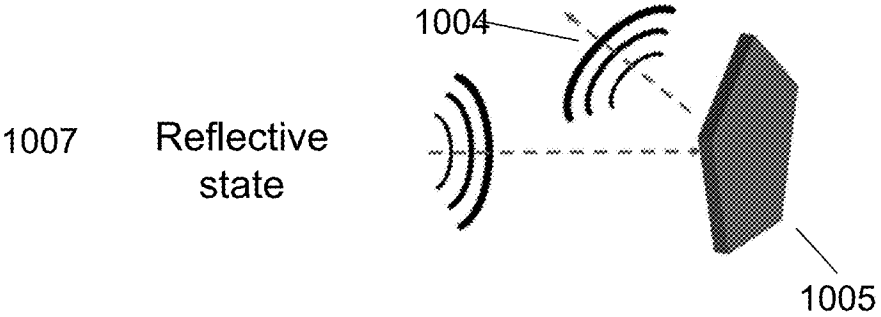

FIG. 10B is a graphic rendering of the band-pass metamaterial of FIG. 10A here configured to be in its reflective state in accordance with an embodiment of the present invention. When activated to be reflective, the metamaterial 1005 will reflect the electromagnetic wave at the pass-band frequency 1004. The active metamaterial is made of repeated structures with electronic components that can be controlled through electronic means. The active metamaterial can be an electromagnetic band-pass or band-reject filter. A band reject filter rejects a desired band of radio frequencies by reflecting them and lets other frequencies outside the desired band to transmit through.

Figure 10C:
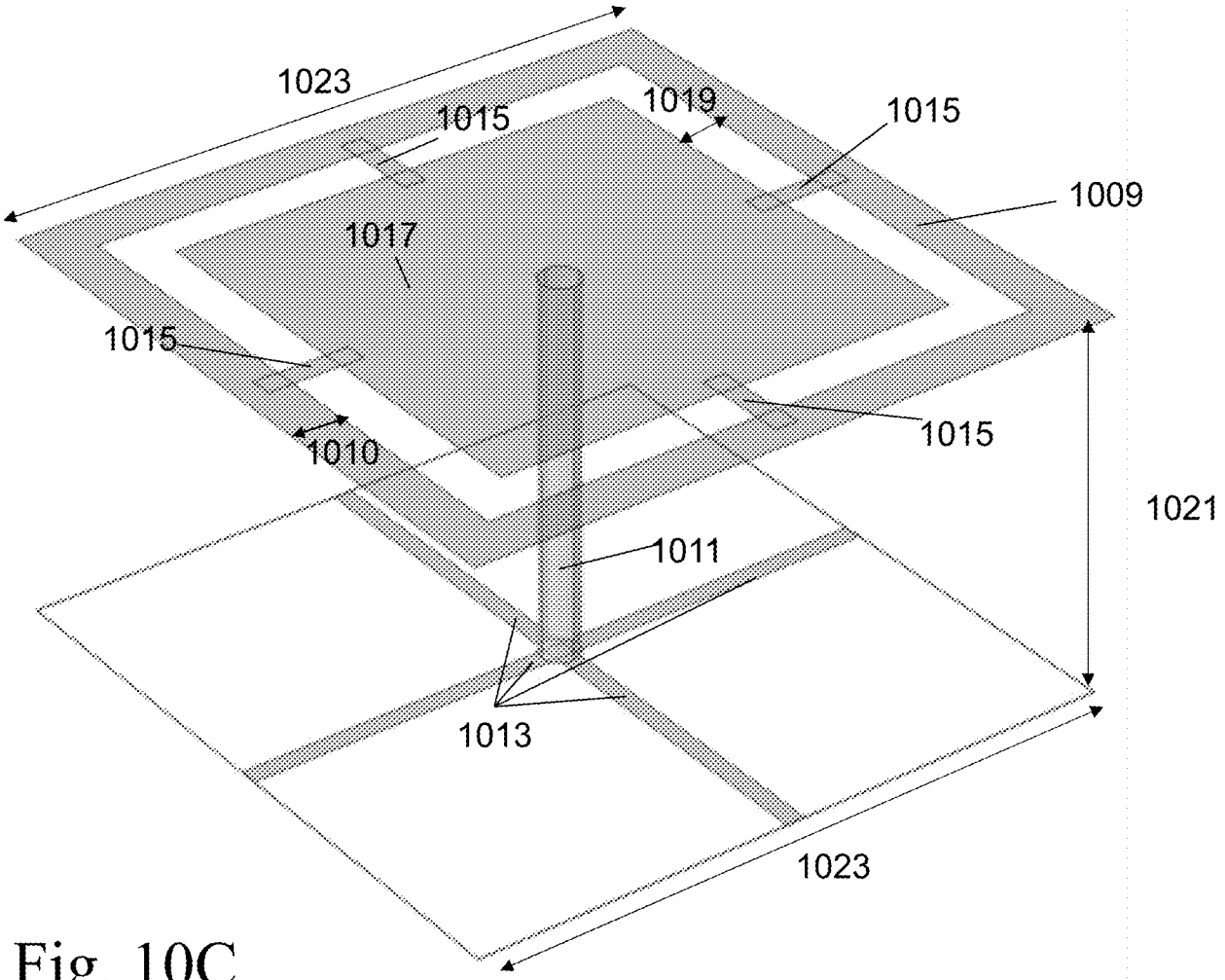

In an embodiment of the present invention, each active metamaterial panel of a given envelope of a reconfigurable antenna is composed of a set of cells, regularly repeated over the envelope. Each cell in the envelope of this embodiment is separately addressable and coupled to the controller of the reconfigurable antenna. In various embodiments, each cell is a square element. FIG. 10C is a perspective rendering of such a cell having a square element periodic structure with electronic components configured to form an active band-pass metamaterial unit with dimensions that control a property of the active band-pass metamaterial in accordance with an embodiment of the present invention. The shaded regions 1009, 1017, 1013 and 1011 identify conductive media. Parameters of the unit such as width 1010 of outer square loop, width 1019 of the non-conductive gap, the dimension 1023 of a spatial period of the unit, the height 1021 of the substrate separating the bottom grid and top periodic structure etc. determine the filter characteristics (such as resonant frequency, bandwidth etc.) of the unit. The distance between the layers and between the elements can be controlled to change the frequency response. Below the element aperture layer including conductive regions 1009, 1017, and 1011 is another grid layer 1013. The two layers are connected by a via or metal post 1011. To affect characteristics of the metamaterial, electronic components such as PIN, PN, transistors (BJT, MOSFET etc.), lumped inductors and capacitors and varactor diodes, or combinations of these elements connected alone, in series, in parallel or combinations of series and parallel, are placed across the non-conductive gap 1015 such that these elements are effectively connected in a parallel circuit with an applied voltage on a single top layer 1009 and the bottom layer grid layer 1013 grounded. The PN, PIN, varactor diodes can be arranged to be forward, reverse biased or a combination distributed around the ring or through other bottom grid layers and top layers. Because in some instances, the RF power impinging on the metamaterial may drive the diodes into breakdown, the diodes can be selected with higher breakdown voltages or series combinations of diodes can be used to lower the breakdown voltage of each diode, so as to increase the power handling capability of the metamaterial.

Figure 10D:
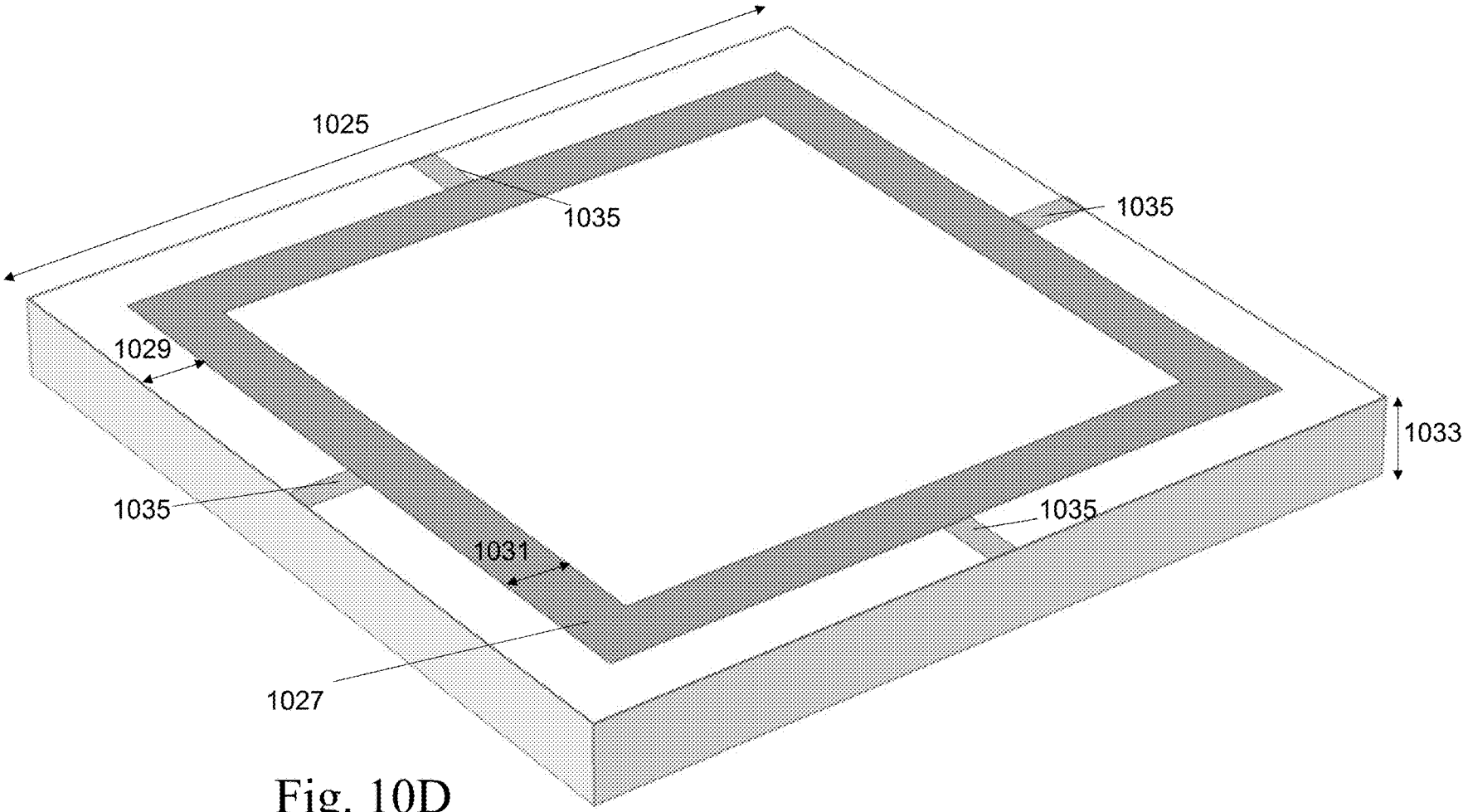

FIG. 10D is perspective rendering of a cell having a square element periodic structure with electronic components, similar to that of FIG. 10C, but configured to form an active band-reject metamaterial unit with dimensions that control a property of the active band-reject metamaterial in accordance with an embodiment of the present invention. In a manner analogous to the embodiment of FIG. 10C, the resonant frequency of maximum reflectance is determined by parameters including the dimension 1025 of a spatial period of the unit, the width 1031 of the conductive loop, the separation distance 1029 between the conducive loop and the outer boundary of the unit, and the substrate thickness 1033. Similarly, as in the case of FIG. 10C, to affect characteristics of the metamaterial, electronic components such as PIN, PN, transistors (BJT, MOSFET etc.), lumped inductors and capacitors and varactor diodes, or combinations of these elements connected alone, in series, in parallel or combinations of series and parallel, are placed across the gap 1029, such that these elements are effectively connected in series on the single top layer. The combinations, type and number of elements placed across these allow for a multitude of behaviors. The use of lumped elements can change the resonant frequency ($f_0$) by modifying the capacitance ('C') or inductance ('L') according to the formula $$f_0 = \frac{1}{2\pi\sqrt{LC}}.$$

Figure 11:
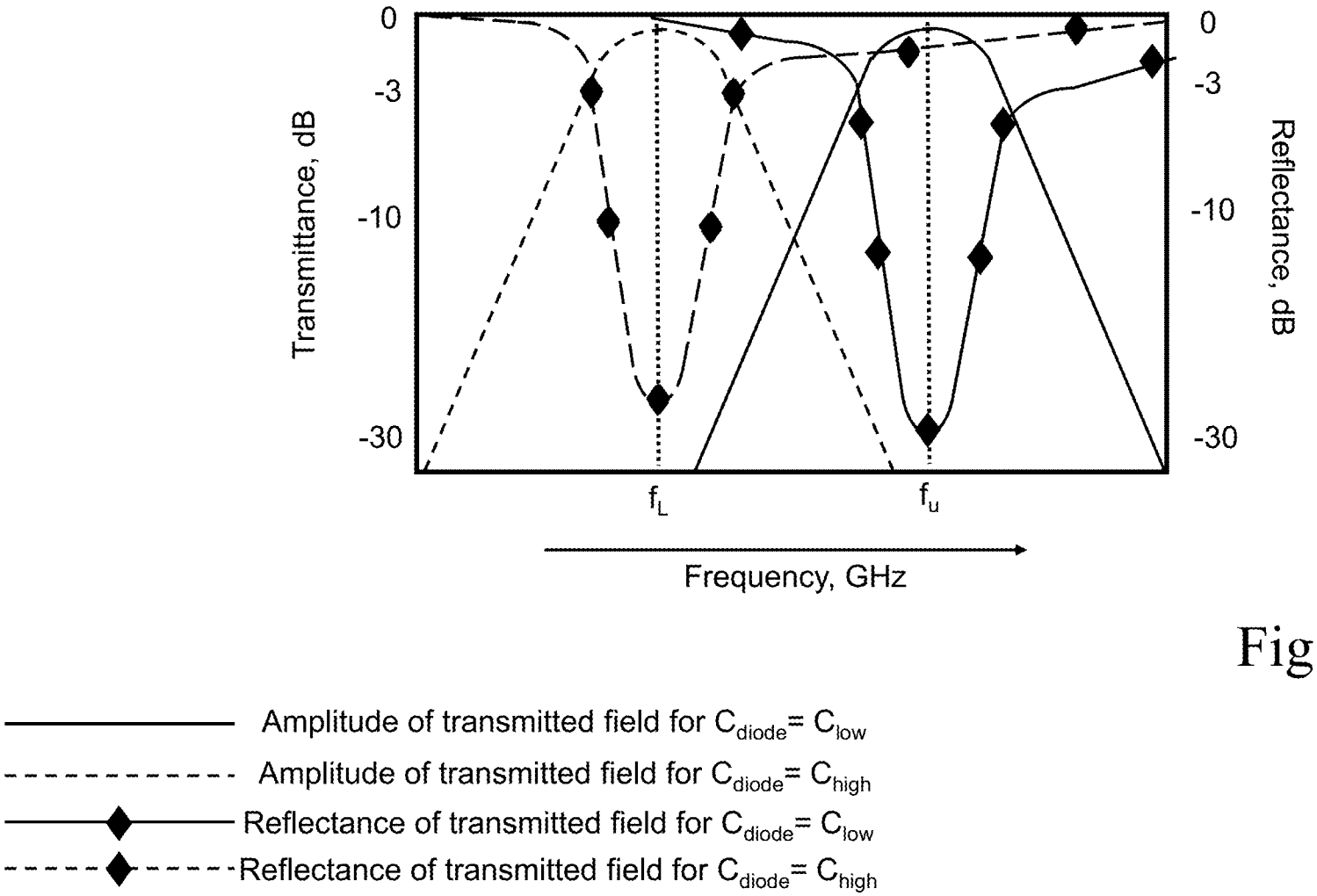
FIG. 11 is a graph plotting the transmittance and reflectance, as a function of frequency, of an active metamaterial design, in accordance with an embodiment of the present invention, using PIN, PN or varactor diodes in forward or reverse bias.

FIG. 11 is a graph plotting the transmittance and reflectance, as a function of frequency, of an active metamaterial design, in accordance with an embodiment of the present invention, using PIN, PN or varactor diodes in forward or reverse bias. When a diode is off, the diode's capacitance is at capacitance maximum. The increase in capacitance resulting from the off condition of the diode lowers the resonant frequency of its circuit, making the metamaterial section transparent at $f_L$. In contrast to this circumstance, applying a voltage across the diode in a reverse bias configuration or by forward biasing the diode causes the diode's capacitance to reach its lowest value, resulting in the highest frequency of transmission $f_u$. Thus, increasing the reverse bias voltage across the diode reduces the internal capacitance to produce a tunable frequency range of transmission between $f_u$ and $f_L$.

Figure 12:
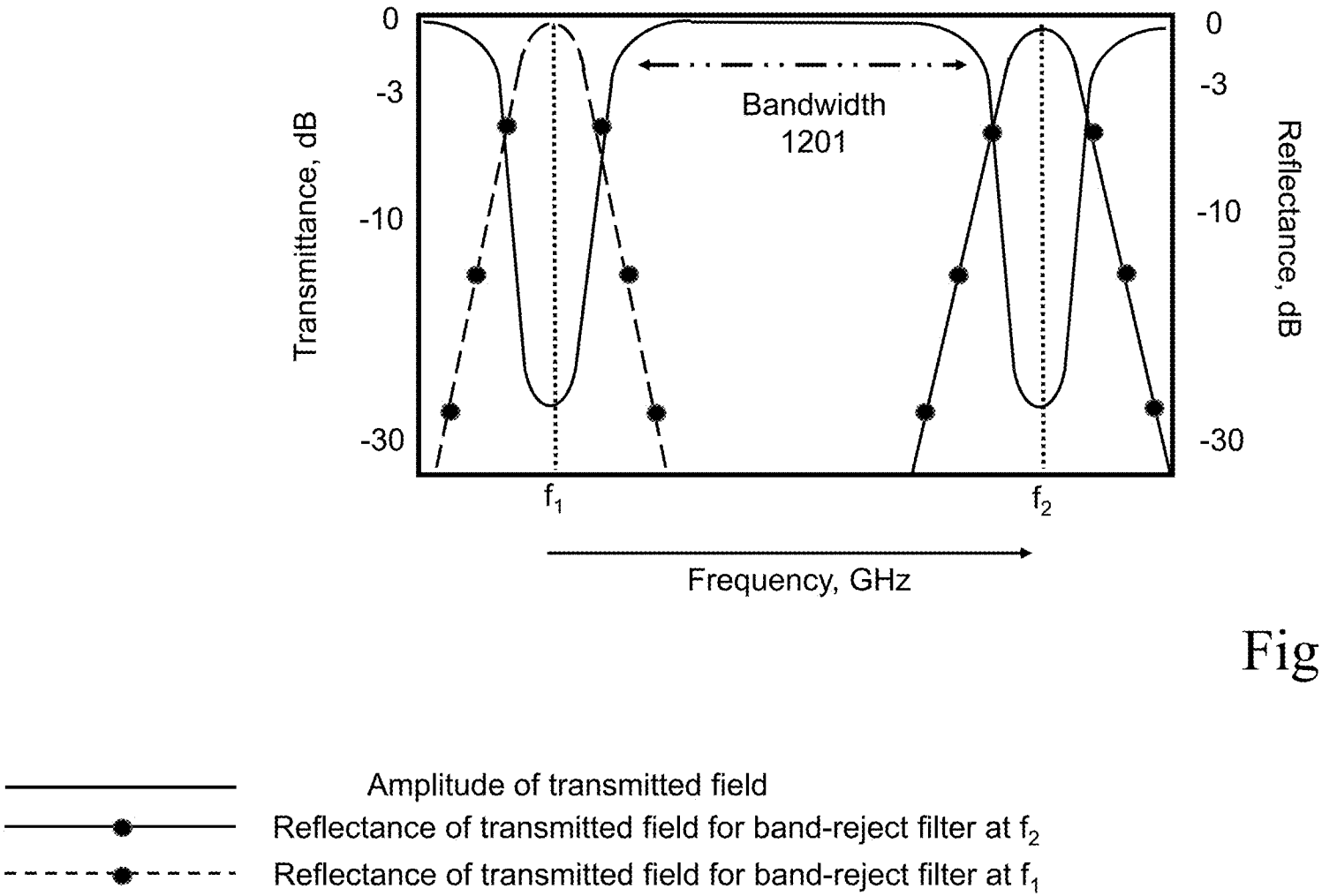
FIG. 12 is a graph plotting the transmittance and reflectance, as a function of frequency, of an active metamaterial design, in accordance with an embodiment of the present invention, in which the metamaterial is configured to provide a filter with variable bandwidth.

FIG. 12 is a graph plotting the transmittance and reflectance, as a function of frequency, of an active metamaterial design, in accordance with an embodiment of the present invention, in which the metamaterial is configured to provide a filter with variable bandwidth. Two band-reject filters with resonant frequencies at $f_1$ and $f_2$ can be tuned with an applied voltage (in reverse bias) shifting the locations of the rejection frequencies $f_1$ and $f_2$ and the resulting transmission bandwidth, 1201, represented by the difference between $f_2$ and $f_1$.

Figure 13:
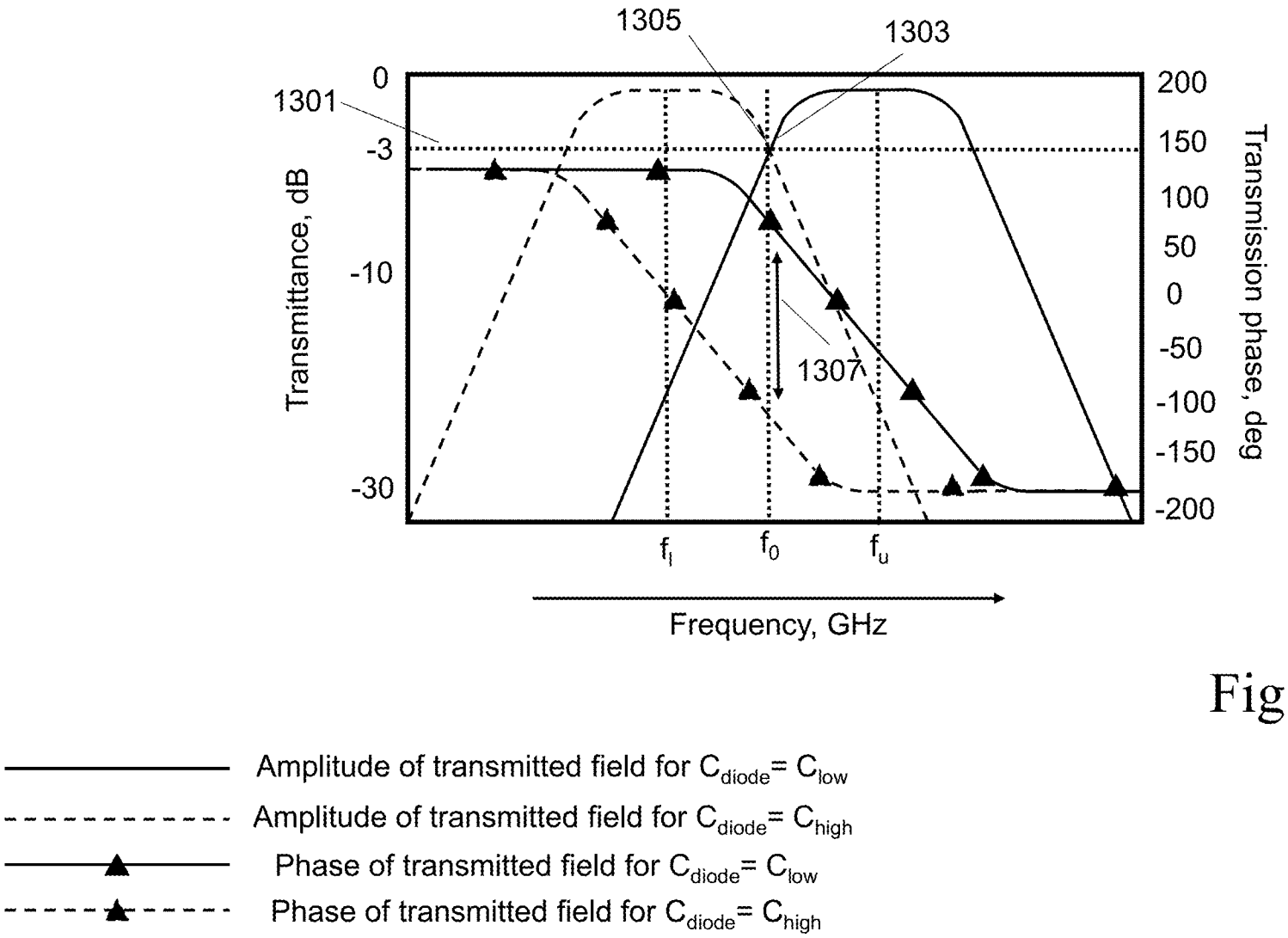
FIG. 13 is a graph plotting the transmittance and reflectance, as a function of frequency, of an active metamaterial design, in accordance with an embodiment of the present invention, in which the metamaterial filter is configured to control the phase of the electromagnetic wave through the metamaterial for beam-steering applications.

FIG. 13 is a graph plotting the transmittance and reflectance, as a function of frequency, of an active metamaterial design, in accordance with an embodiment of the present invention, in which the metamaterial filter is configured to control the phase of the electromagnetic wave through the metamaterial for beam-steering applications. A band-pass active metamaterial exhibits minimal loss at the resonant frequency ($f_L$ or $f_U$). As the junction capacitance varies both the resonant frequency and the amplitude and phase of the transmitted field, the response varies between these frequencies represented by the highest ($f_L$) and lowest capacitance ($f_u$) values of the diode. When using the tunable metamaterial for beam-steering purposes, the amplitude and phase response at a single frequency should be considered. Assuming a maximum loss level, given by 1301 which in this case is at −3 dB, the operating frequency $f_0$ is the lower cutoff frequency, at this minimum transmissivity level, when the diode capacitance is set at its smallest value resulting in a resonant frequency $f_u$. The phase of the field transmitted through can then be controllably changed by increasing the diode capacitance until the upper cutoff frequency is equal to the operating frequency. The amplitude losses would never exceed the value 1301 within which the filter was designed to operate, and the phase change possible is given by 1307. Each metamaterial section can be controlled to modify the phase of the electromagnetic wave passing through it.

Figure 14:
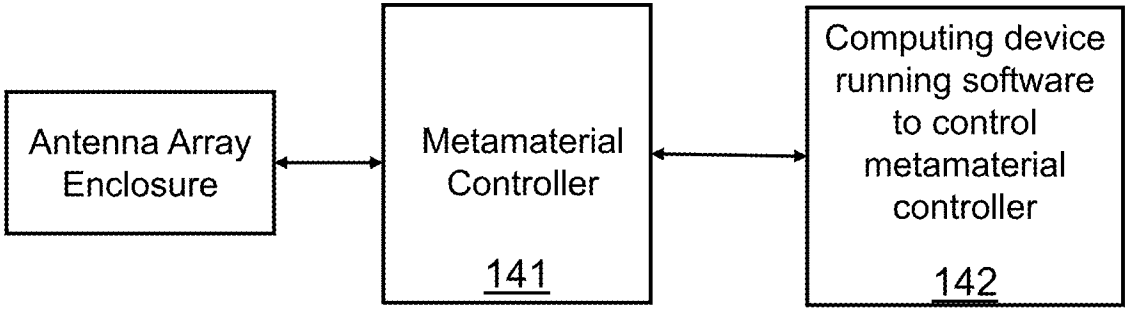
FIG. 14 is a block diagram of subsystems used in an embodiment of a configurable antenna array in accordance with the present invention.

FIG. 14 is a block diagram of subsystems used in an embodiment of a configurable antenna array in accordance with the present invention. The individual active metamaterial panels are individually addressed and controlled by a metamaterial controller 141 by applying voltage or current to the panels to activate the metamaterial and control their individual properties. A computing device 142 runs software that controls the metamaterial controller. The computing device can be an ASIC, microcontroller, computer, FPGA, or programmable array logic (PAL) or any other device that can run software algorithms and interface with the metamaterial controller. The software algorithm used to address and actuate a single metamaterial element is described in connection with FIG. 15.

Figure 15:
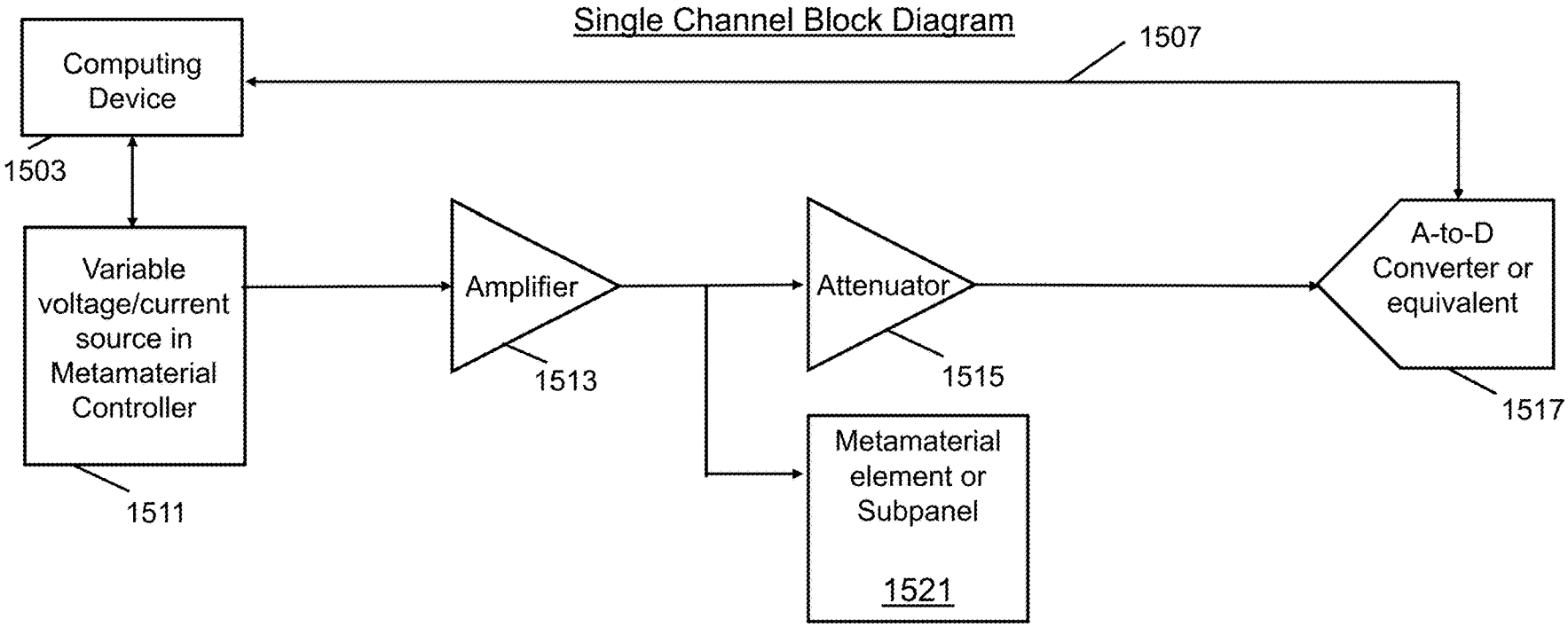
FIG. 15 is a schematic diagram of a control system used, in an embodiment of the present invention, to actuate a single metamaterial element, panel, or sub-panel of the antenna array enclosure system.

FIG. 15 is a schematic diagram of a control system used, in an embodiment of the present invention, to actuate a single metamaterial element, panel, or sub-panel of the antenna array enclosure system. The software algorithm on the computing device 1503 outputs a variable voltage or current source 1511 in the metamaterial controller. The voltage or current source is processed by amplifier 1513 if necessary, before activating the metamaterial element or subpanel 1521. The voltage or current applied can be attenuated 1515 before being measured by the analog-to-digital converter 1517 or equivalent measuring equipment. The measured value is fed back to the computing device as a feedback system 1507 ensuring that the correct voltage or current value setting is being sent to the voltage/current source.

Figure 16:
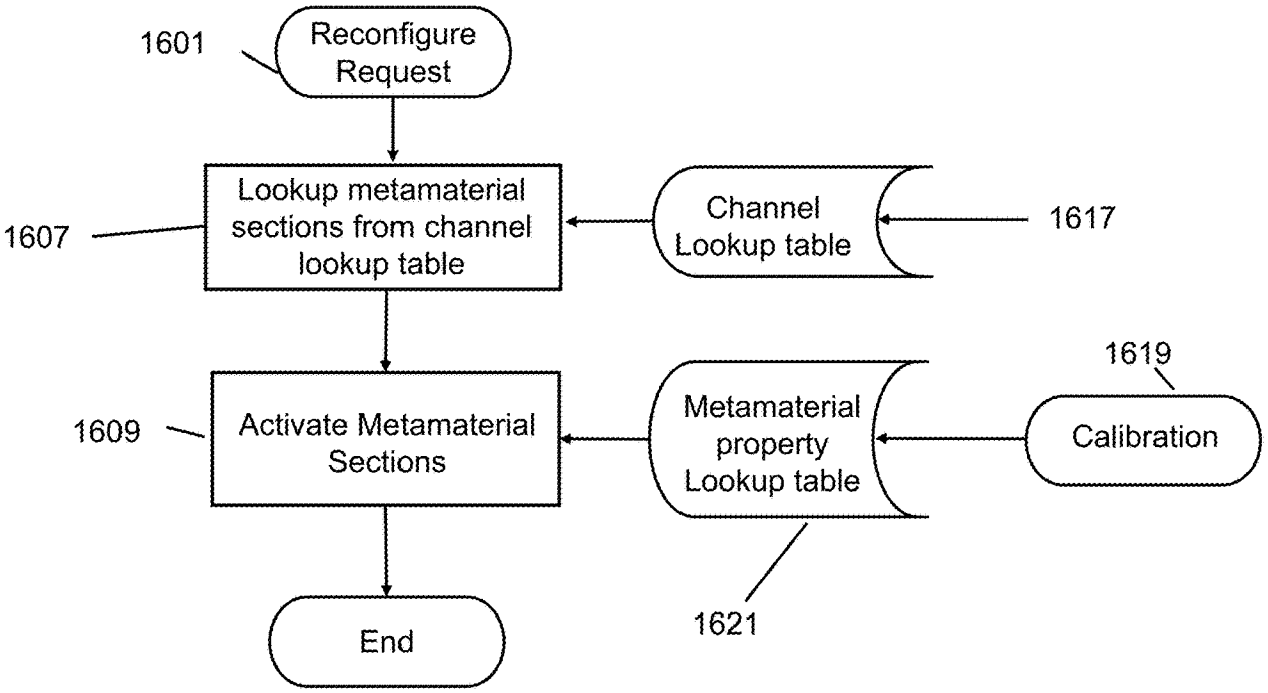
FIG. 16 is a diagram of the basic software control algorithm implemented by the metamaterial controller in accordance with an embodiment of the present invention.

FIG. 16 is a diagram of the basic software control algorithm implemented by the metamaterial controller in accordance with an embodiment of the present invention. Every request to reconfigure the antenna, received at input 1601, is handled in process 1607 to identify a corresponding channel through a controller channel lookup table 1617 between the metamaterial controller and the individual metamaterial subpanels. The channel lookup table 1617 is a lookup table mapping the individual voltage or current channels on the metamaterial controller board to the individual metamaterial sections of the antenna enclosure as described in FIG. 14. The channel lookup table 1617 identifies the appropriate channels before a voltage or current is applied in process 1609 by the metamaterial controller to activate the appropriate metamaterial sections to be reflective and transmissive. In process 1609, the channels are then activated by the metamaterial controller of FIG. 14, using the metamaterial property lookup table 1621, which maps voltage and current with values of frequency of transmissivity, reflectance, phase shift, absorption, polarization change, bandwidth change and angle sensitivity as needed by the reconfigure request 1601. The lookup table 1621 is generated through a calibration operation 1619, which records all metamaterial properties as a function of voltage and/or current. In one exemplary operation, half of the metamaterial sections on a parabolic surface of revolution antenna array enclosure are activated to be reflective at frequency $f_1$, with the remaining sections transparent at $f_1$, such that the RF beam is concentrated northward. The antenna reconfigure request 1601 is processed by the software running on the computing device 142 of FIG. 14A. The appropriate metamaterial sections and their corresponding voltage or current channels that need to be activated by the metamaterial controller are looked up from the channel lookup table of 1617. To activate the appropriate channels and in effect the appropriate metamaterial sections to tune to be reflective and transmissive at frequency $f_1$, the appropriate voltage or current value is to be applied to the appropriate channels. The appropriate voltage or current values are obtained from the metamaterial property lookup table 1621, which maps the various voltage and current values with desired metamaterial properties of frequency of transmissivity, reflectance, phase shift, absorption, polarization change, bandwidth change and angle sensitivity as is needed by the reconfigure request.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A reconfigurable antenna comprising:

a set of at least two envelopes of active metamaterial panels, each envelope in the set being shaped to approximate a surface of at least partial revolution of a curve about an axis, with the set of envelopes having surfaces collectively defining a focal locus and at least one envelope in the set having curvature about two orthogonal axes;

wherein at least one of the envelopes is configured to overlie at least a portion of another one of the envelopes;

a wideband antenna array disposed within the focal locus;

a controller, coupled to the panels, configured to independently activate each one of the panels, so as to control a property of each of the panels, the property selected from the group consisting of transmissivity, reflectivity, absorption, phase, polarization, bandwidth, angle sensitivity, resonant frequency, and combinations thereof.

2. A reconfigurable antenna according to claim 1 wherein the curve is a parabola.

3. A reconfigurable antenna according to claim 1 wherein the curve is an arc of a circle.

4. A reconfigurable antenna according to claim 1 wherein the curve is elliptical.

5. A reconfigurable antenna according to claim 1, wherein the controller is further configured to select a set of panels to be activated in a manner that causes formation of a beam of RF energy having a desired orientation in space and beamwidth, and wherein the envelopes are configured to support such beam formation.

6. A reconfigurable antenna according to claim 5, wherein the controller is further configured to select a set of panels to be activated in a manner that causes formation of a plurality of beams of RF energy having a desired orientation in space and beamwidth, and wherein the envelopes are configured to support such beam formation.

7. A reconfigurable antenna according to claim 1, wherein the surface of revolution has a maximum radius and a height that is greater than twice the maximum radius.

8. A reconfigurable antenna according to claim 1, comprising at least three envelopes in the set of envelopes.

9. A reconfigurable antenna according to claim 1, wherein the envelopes are configured to provide at least two layers, wherein each layer substantially surrounds the antenna.

10. A reconfigurable antenna according to claim 1, wherein the controller is further configured to activate a set of panels in a manner as to establish, in the set of envelopes, a set of RF windows, each window transmissive of RF signals at a specified RF frequency.

11. A reconfigurable antenna according to claim 1, wherein the controller is further configured to activate a set of panels in a manner as to establish, in the set of envelopes, a set of RF windows, each window reflective of RF signals at a specified RF frequency.

12. A reconfigurable antenna according to claim 11, wherein the controller is further configured to activate a set of panels as to establish an antenna system having a performance adjustable over 360 degrees of azimuth.

13. A reconfigurable antenna according to claim 11, wherein the controller is further configured to activate a set of panels as to establish an antenna system having a performance adjustable over 180 degrees of elevation.

14. A reconfigurable antenna according to claim 1, wherein each active metamaterial panel of a given envelope comprises a set of cells, regularly repeated over the envelope, wherein each cell is separately addressable and coupled to the controller.

* * * * *